US011761387B1

(12) United States Patent
Fulton et al.

(10) Patent No.: US 11,761,387 B1
(45) Date of Patent: Sep. 19, 2023

(54) SYSTEM AND METHOD FOR FUEL PUMP SHUTDOWN

(71) Applicant: Ford Global Technologies, LLC, Dearborn, MI (US)

(72) Inventors: Brien Fulton, Bloomfield Hills, MI (US); Carlos Armesto, Canton, MI (US); Laural Suzanne-Hughes Feldmeier, Allen Park, MI (US); Kevin M. Bird, South Lyon, MI (US); Christopher Woodring, Canton, MI (US); Timothy J. Knott, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 18/150,489

(22) Filed: Jan. 5, 2023

(51) Int. Cl.

| | |
|---|---|
| ***F02M 53/00*** | (2006.01) |
| ***F02M 59/44*** | (2006.01) |
| ***F02D 1/02*** | (2006.01) |
| ***F02D 41/38*** | (2006.01) |
| ***F02M 59/34*** | (2006.01) |
| ***F02M 65/00*** | (2006.01) |
| ***F02M 51/04*** | (2006.01) |
| ***F02M 59/02*** | (2006.01) |
| ***F02M 53/04*** | (2006.01) |

(52) U.S. Cl.
CPC ..... *F02D 1/02* (2013.01); *F02D 1/025* (2013.01); *F02D 41/3836* (2013.01); *F02M 51/04* (2013.01); *F02M 53/043* (2013.01); *F02M 59/02* (2013.01); *F02M 59/025* (2013.01); *F02M 59/34* (2013.01); *F02M 59/447* (2013.01); *F02M 65/007* (2013.01); *F02D 2200/0606* (2013.01)

(58) Field of Classification Search
CPC .... F02D 1/02; F02D 1/025; F02D 2200/0606; F02M 53/043; F02M 59/02; F02M 59/025; F02M 59/447; F02M 65/007
USPC ..... 123/41.31, 497, 507, 508, 541
See application file for complete search history.

(56) References Cited

U.S. PATENT DOCUMENTS

| | | | | |
|---|---|---|---|---|
| 4,098,236 | A * | 7/1978 | Okawa | F02M 37/0023 123/41.31 |
| 4,261,308 | A * | 4/1981 | Hadekel | F02M 59/447 123/495 |
| 5,832,903 | A * | 11/1998 | White | F02M 31/20 123/541 |
| 7,159,551 | B2 | 1/2007 | Cecur et al. | |
| 7,404,383 | B2 | 7/2008 | Elendt | |
| 7,448,361 | B1 * | 11/2008 | Pursifull | F02M 59/42 123/456 |
| 9,605,603 | B2 | 3/2017 | Glugla et al. | |

(Continued)

FOREIGN PATENT DOCUMENTS

| | | | | |
|---|---|---|---|---|
| DE | 19530261 | A1 * | 2/1996 | F02M 37/20 |
| DE | 10061852 | A1 | 6/2002 | |
| DE | 102010041232 | A1 | 3/2012 | |

*Primary Examiner* — Erick R Solis
(74) *Attorney, Agent, or Firm* — Vincent Mastrogiacomo; McCoy Russell LLP

(57) ABSTRACT

Methods and systems for operating an engine that includes two fuel pumps are described. In one example, a first fuel pump may be activated or remain activated in response to an engine shutdown request so that a second fuel pump may be cooled before the first fuel pump is deactivated in response to the engine shutdown request.

20 Claims, 6 Drawing Sheets

(56) References Cited

U.S. PATENT DOCUMENTS

| | | | | |
|---|---|---|---|---|
| 2010/0030456 | A1 | 2/2010 | Chominsky et al. | |
| 2015/0098848 | A1* | 4/2015 | Kato | F02M 59/367 417/437 |
| 2018/0347491 | A1* | 12/2018 | Rousseau | F02D 41/064 |
| 2019/0257250 | A1* | 8/2019 | Veilleux, Jr. | F04D 13/12 |
| 2021/0033032 | A1* | 2/2021 | Jaasma | F02M 21/0212 |
| 2021/0340907 | A1* | 11/2021 | O'Connor | F23K 5/08 |
| 2021/0363941 | A1 | 11/2021 | Revidat et al. | |

* cited by examiner

SYSTEM AND METHOD FOR FUEL PUMP SHUTDOWN

BACKGROUND/SUMMARY

An engine may be supplied with fuel that is delivered via two fuel pumps. A first fuel pump may be described as a low-pressure fuel pump because it delivers fuel at a pressure that is lower relative to a fuel pressure that is delivered by a second fuel pump. The second fuel pump may be arranged in series with the first fuel pump and the second fuel pump may be described as a high-pressure fuel pump because it delivers fuel at is at a higher pressure than fuel that is delivered by the low-pressure fuel pump. The high-pressure fuel pump may be driven via an engine in which drive work generates heat internal to the pump to pressurize the fuel. Further, the high-pressure fuel pump may be exposed to temperatures around the engine so that the fuel in the high-pressure fuel pump is heated by higher engine temperatures. The higher fuel temperatures from the internal generated heat and the higher engine temperature exposure may lead to deposits forming within the high-pressure fuel pump. The deposits may degrade high pressure fuel pump operation (e.g., lower efficiency and pumping capacity) and degrade the pump. Therefore, it may be desirable to provide a way of reducing a possibility of high-pressure fuel pump degradation and increasing fuel pump cooling.

The inventors herein have recognized the above-mentioned disadvantages and have developed an engine operating method, comprising: via a controller, adjusting an operating state of a first fuel pump in response to an engine shutdown request and a pump temperature and/or pump fuel temperature, the first fuel pump arranged serially with a second fuel pump.

By adjusting an operating state of a first fuel pump in response to an engine shutdown request and a pump temperature and/or pump fuel temperature, it may be possible to provide the technical result of lowering the fuel pump temperature and possibility of fuel degradation and deposit formation. In particular, a first fuel pump may be activated or remain activated after an engine shutdown or stop request so that a second fuel pump may be cooled. Cooling the second fuel pump may reduce a possibility of deposits forming within the second fuel pump. Additionally, the first fuel pump may be cycled on and off a plurality of times after an engine shutdown request so that pressure pulses may increase flushing of deposit forming fuel from the second fuel pump. The second fuel pump may be off (e.g., not rotating) while the first fuel pump is activated.

The present description may provide several advantages. In particular, the approach may reduce a possibility of fuel pump degradation. In addition, the approach may reduce formation of deposits within a fuel pump. Further, the approach may be performed with existing engine hardware so that system costs may not be affected by the present approach.

The above advantages and other advantages, and features of the present description will be readily apparent from the following Detailed Description when taken alone or in connection with the accompanying drawings.

It is to be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
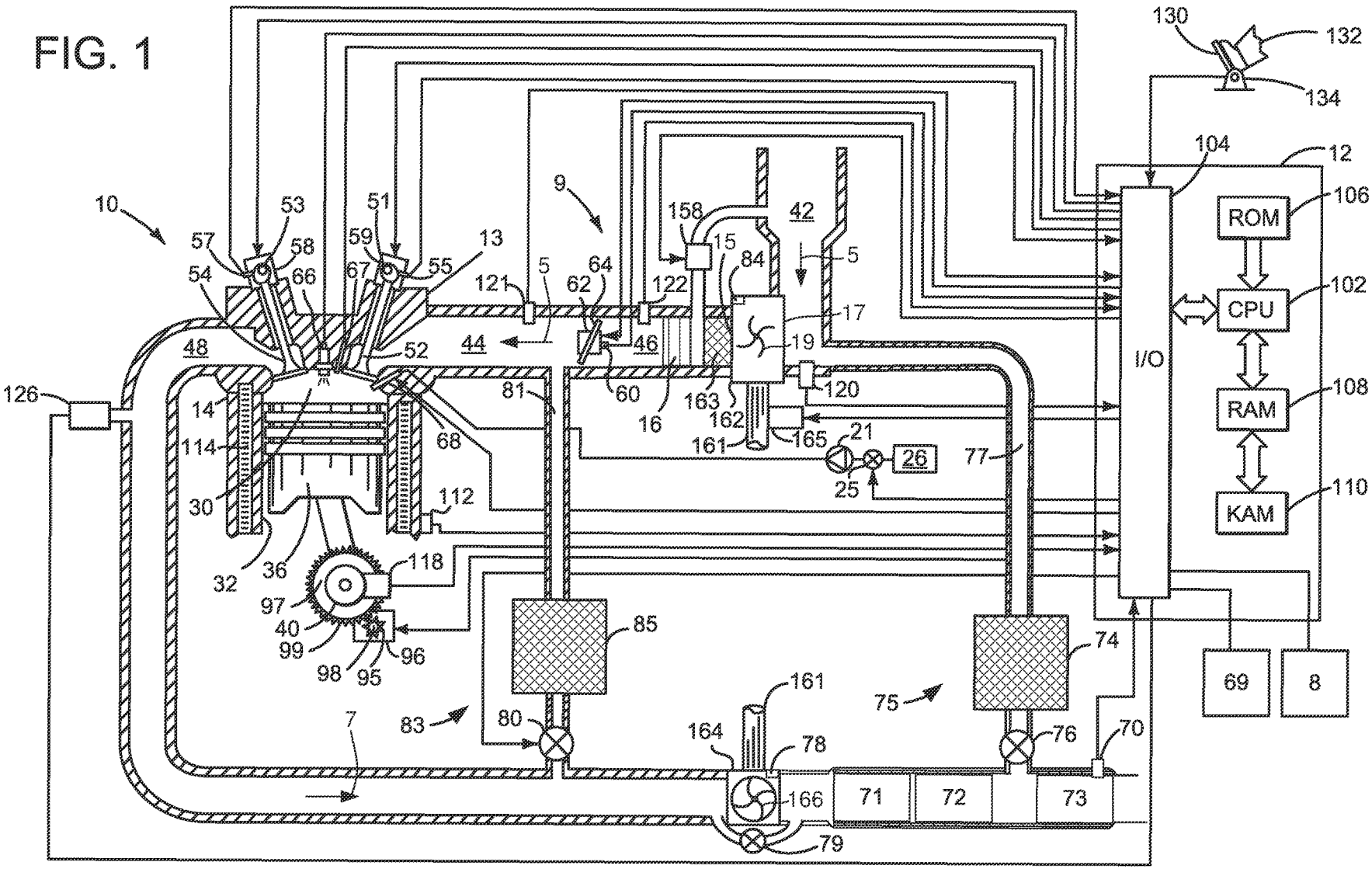
FIG. 1 shows a detailed schematic depiction of an example engine.
Figure 2:
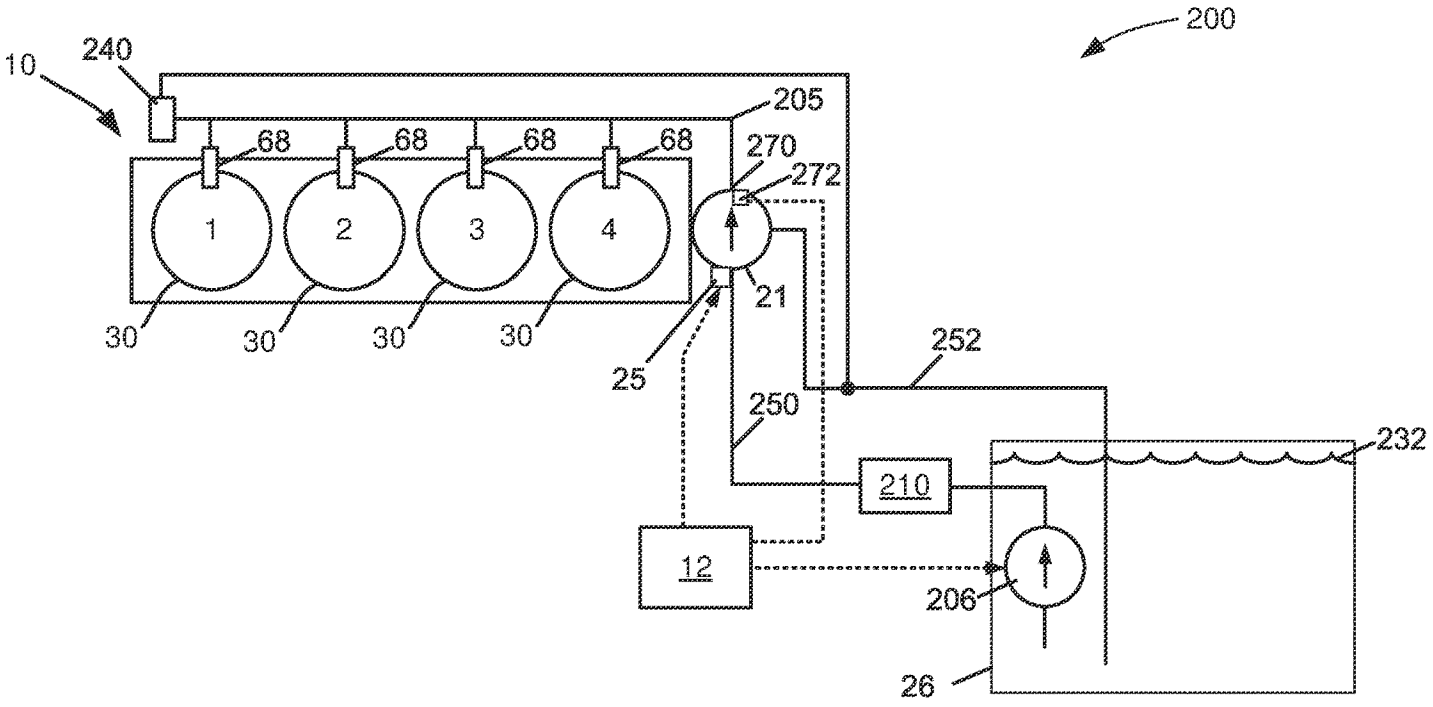
FIG. 2 is a schematic view of a fuel system for the example engine of FIG. 1.
Figure 3:
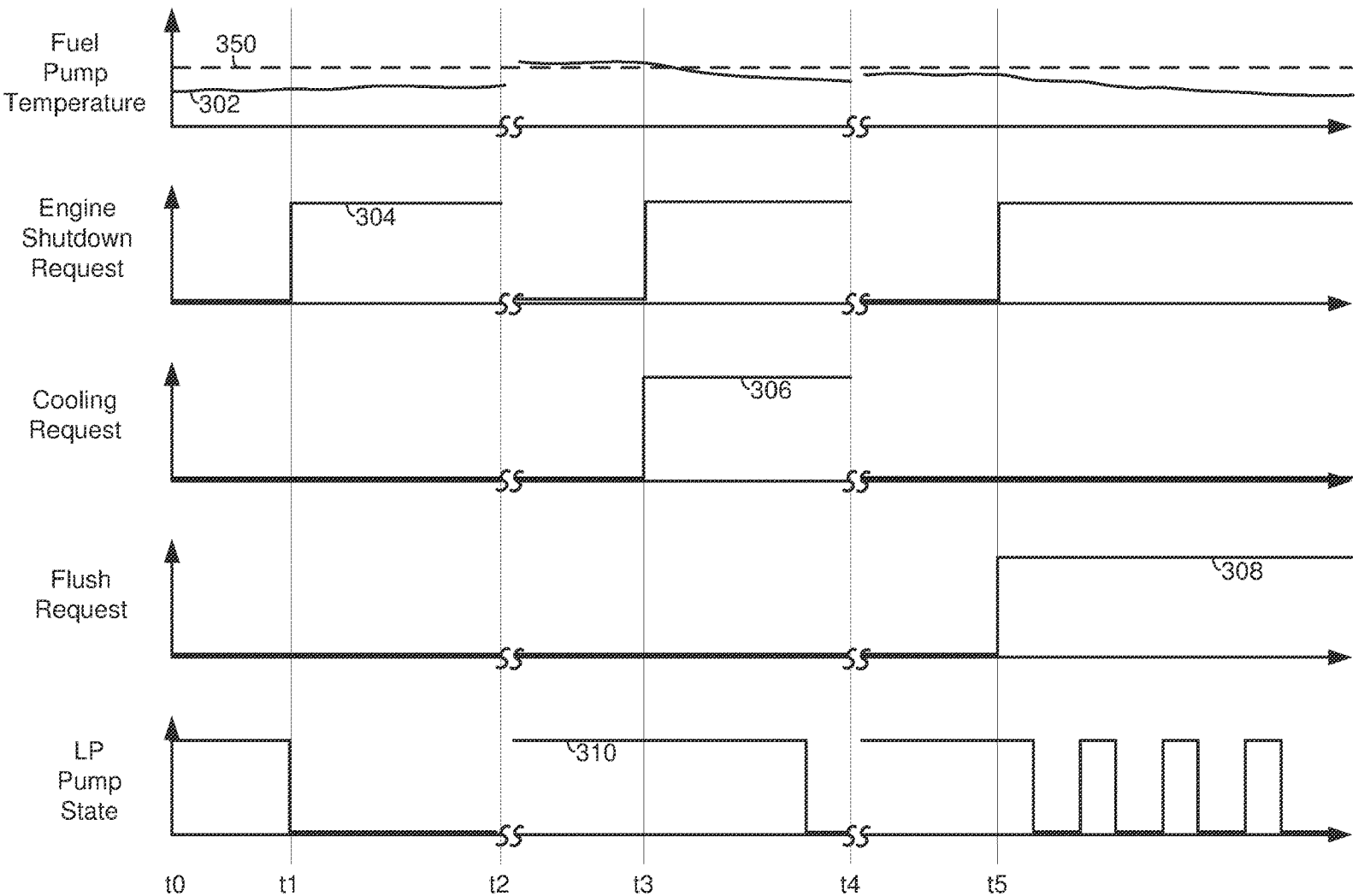
FIG. 3 shows an example operating sequence of the method of FIGS. 4-6.
Figure 4:
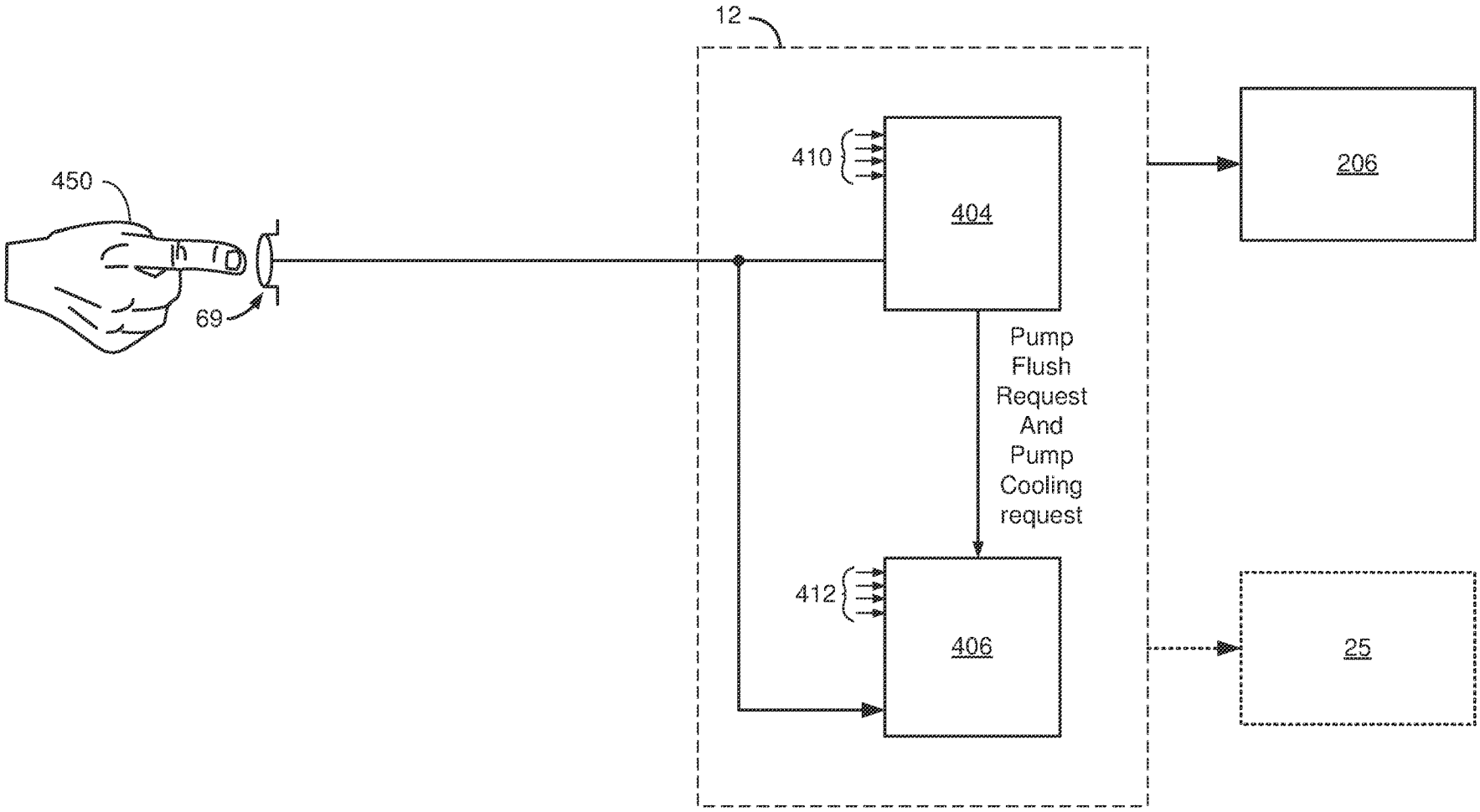
FIGS. 4-6 show block diagrams of a method for operating an engine.
Figure 5:
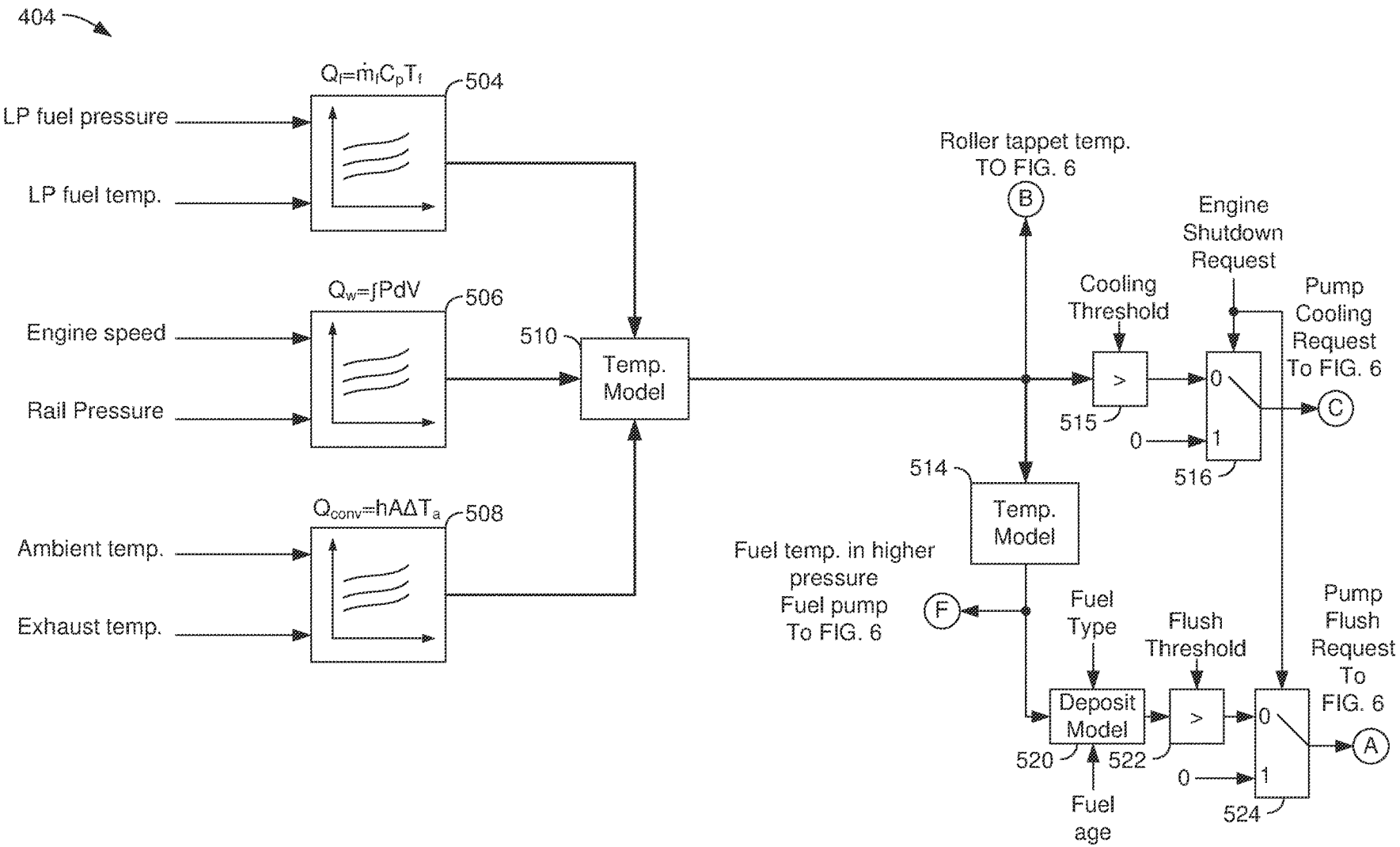
Figure 6:
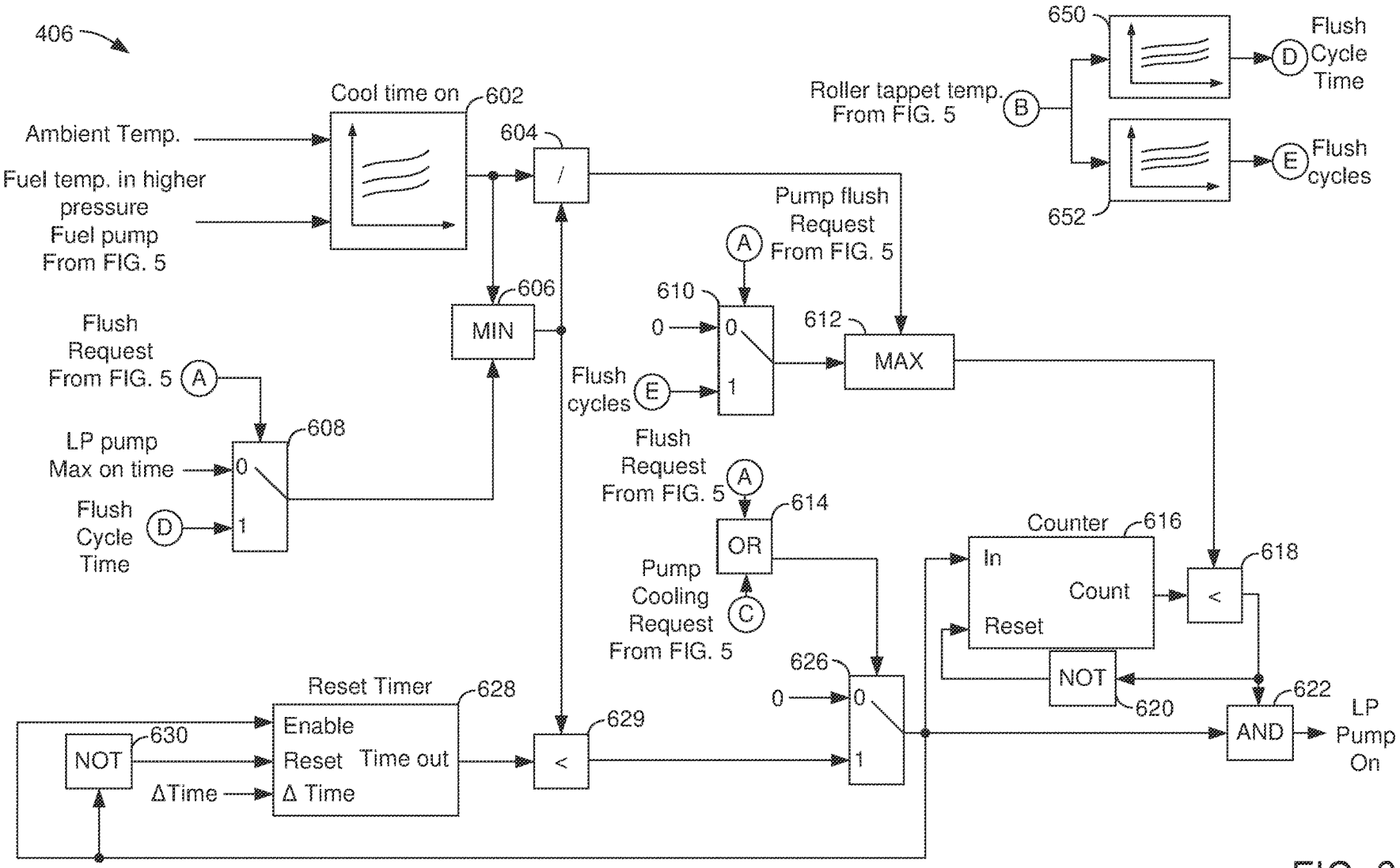

The present description is related to operating an engine (e.g., a direct injection petrol or diesel engine). FIG. 1 shows one example engine in which fuel pump operation may be adjusted to reduce a possibility of fuel pump degradation after an engine shutdown request. If the engine has recently operated at higher speeds and loads where fuel temperature may increase, stopping the engine shortly after operating the engine at the higher speeds and loads may allow deposits to form in a fuel pump. The deposits may increase the possibility of fuel pump degradation over time. An example fuel system that may be operated according to the method described herein is shown in FIG. 2. The fuel system may be operated as shown in the sequence of FIG. 3. FIGS. 4-6 show a block diagram of a method for operating an engine and the engine's fuel pumps.

Referring to FIG. 1, internal combustion engine 10, comprising a plurality of cylinders, one cylinder of which is shown in FIG. 1, is controlled by electronic engine controller 12. The controller 12 receives signals from the various sensors of FIG. 1 and employs the various actuators of FIG. 1 to adjust engine operation based on the received signals and instructions stored on a memory of the controller.

Engine 10 includes combustion chamber 30 and cylinder walls 32 with piston 36 positioned therein and connected to crankshaft 40. Cylinder head 13 is fastened to engine block 14. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Although in other examples, the engine may operate valves via a single camshaft or pushrods. The position of intake cam 51 may be determined by intake cam sensor 55. The position of exhaust cam 53 may be determined by exhaust cam sensor 57. Intake poppet valve 52 may be operated by a variable valve activating/deactivating actuator 59, which may be a cam driven valve operator (e.g., as shown in U.S. Pat. Nos. 9,605,603; 7,404,383; and 7,159,551 all of which are hereby fully incorporated by reference for all purposes). Likewise, exhaust poppet valve 54 may be operated by a variable valve activating/deactivating actuator 58, which may a cam driven valve operator (e.g., as shown in U.S. Pat. Nos. 9,605,603; 7,404,383; and 7,159,551 all of which are hereby fully incorporated by reference for all purposes). Intake poppet valve 52 and exhaust poppet valve 54 may be deactivated and held in a closed position preventing flow into and out of cylinder 30 for one or more entire engine cycles (e.g. two engine revolutions), thereby deactivating cylinder 30. Flow of fuel supplied to cylinder 30 may also cease when cylinder 30 is deactivated.

Fuel injector 68 is shown positioned in cylinder head 13 to inject fuel directly into combustion chamber 30, which is known to those skilled in the art as direct injection. Fuel is delivered to fuel injector 68 by a fuel system including a fuel tank 26, low pressure fuel pump (not shown), high pressure fuel pump 21, fuel pump volume control valve 25, and fuel rail (not shown). A more detailed schematic of the fuel system is shown in FIG. 2.

Engine air intake system 9 includes intake manifold 44, throttle 62, grid heater 16, charge air cooler 163, turbocharger compressor 162, and intake plenum 42. Intake manifold 44 is shown communicating with optional electronic throttle 62 which adjusts a position of throttle plate 64 to control air flow from intake boost chamber 46. Compressor 162 draws air from air intake plenum 42 to supply boost chamber 46. Compressor vane actuator 84 adjusts a position of compressor vanes 19. Exhaust gases spin turbine 164 which is coupled to turbocharger compressor 162 via shaft 161. In some examples, a charge air cooler 163 may be provided. Further, an optional grid heater 16 may be provided to warm air entering cylinder 30 when engine 10 is being cold started. Compressor speed may be adjusted via adjusting a position of turbine variable vane control actuator 78 or compressor recirculation valve 158. In alternative examples, a waste gate 79 may replace or be used in addition to turbine variable vane control actuator 78. Turbine variable vane control actuator 78 adjusts a position of variable geometry turbine vanes 166. Exhaust gases can pass through turbine 164 supplying little energy to rotate turbine 164 when vanes are in an open position. Exhaust gases can pass through turbine 164 and impart increased force on turbine 164 when vanes 166 are in a closed position. Alternatively, wastegate 79 or a bypass valve may allow exhaust gases to flow around turbine 164 so as to reduce the amount of energy supplied to the turbine. Compressor recirculation valve 158 allows compressed air at the outlet 15 of compressor 162 to be returned to the inlet 17 of compressor 162. Alternatively, a position of compressor variable vane actuator 78 may be adjusted to change the efficiency of compressor 162. In this way, the efficiency of compressor 162 may be reduced so as to affect the flow of compressor 162 and reduce the possibility of compressor surge. Further, by returning air back to the inlet 17 of compressor 162, work performed on the air may be increased, thereby increasing the temperature of the air. Optional electric machine 165 is also shown coupled to shaft 161. Optional electric machine 165 may rotate compressor 162 when engine 10 is not rotating, when engine 10 is rotating at low speed (e.g., cranking speed such as 250 RPM), or when exhaust energy is low to provide additional boost. Air flows into engine 10 in the direction of arrows 5.

Flywheel 97 and ring gear 99 are coupled to crankshaft 40. Starter 96 (e.g., low voltage (operated with less than 30 volts) electric machine) includes pinion shaft 98 and pinion gear 95. Pinion shaft 98 may selectively advance pinion gear 95 to engage ring gear 99 such that starter 96 may rotate crankshaft 40 during engine cranking. Starter 96 may be directly mounted to the front of the engine or the rear of the engine. In some examples, starter 96 may selectively supply torque to crankshaft 40 via a band or chain. In one example, starter 96 is in a base state when not engaged to the engine crankshaft. An engine start/stop may be requested via human/machine interface (e.g., key switch, pushbutton, remote radio frequency emitting device, etc.) 69 or in response to vehicle operating conditions (e.g., brake pedal position, accelerator pedal position, battery SOC, etc.). Battery 8 may supply electrical power to starter 96 and electric machine 165. Controller 12 may monitor battery state of charge.

Combustion is initiated in the combustion chamber 30 when fuel automatically ignites via combustion chamber temperatures reaching the auto-ignition temperature of the fuel that is injected to cylinder 30. The temperature in the cylinder increases as piston 36 approaches top-dead-center compression stroke. In some examples, a universal Exhaust Gas Oxygen (UEGO) sensor 126 may be coupled to exhaust manifold 48 upstream of emissions device 71. In other examples, the UEGO sensor may be located downstream of one or more exhaust after treatment devices. Further, in some examples, the UEGO sensor may be replaced by a NOx sensor that has both NOx and oxygen sensing elements.

At lower engine temperatures optional glow plug 66 may convert electrical energy into thermal energy so as to create a hot spot next to one of the fuel spray cones of an injector in the combustion chamber 30. By creating the hot spot in the combustion chamber 30 next to sprayed fuel, it may be easier to ignite the fuel spray plume in the cylinder, releasing heat that propagates throughout the cylinder, raising the temperature in the combustion chamber, and improving combustion. Cylinder pressure may be measured via optional pressure sensor 67, alternatively or in addition, sensor 67 may also sense cylinder temperature.

Emissions device 71 can include an oxidation catalyst and it may be followed by a diesel particulate filter (DPF) 72 and a selective catalytic reduction (SCR) catalyst 73, in one example. In another example, DPF 72 may be positioned downstream of SCR 73. Temperature sensor 70 provides an indication of SCR temperature. Exhaust flows in the direction of arrow 7.

Exhaust gas recirculation (EGR) may be provided to the engine via high pressure EGR system 83. High pressure EGR system 83 includes EGR valve 80, EGR passage 81, and EGR cooler 85. EGR valve 80 is a valve that closes or allows exhaust gas to flow from upstream of emissions device 71 to a location in the engine air intake system downstream of compressor 162. EGR may be cooled via passing through EGR cooler 85. EGR may also be provided via low pressure EGR system 75. Low pressure EGR system 75 includes EGR passage 77 and EGR valve 76. Low pressure EGR may flow from downstream of emissions device 71 to a location upstream of compressor 162. Low pressure EGR system 75 may include an EGR cooler 74.

Controller 12 is shown in FIG. 1 as a conventional microcomputer including: microprocessor unit 102, input/output ports 104, read-only memory (e.g., non-transitory memory) 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to a driver demand pedal 130 for sensing driver demand pedal position adjusted by human foot 132; a measurement of engine manifold pressure (MAP) from pressure sensor 121 coupled to intake manifold 44 (alternatively or in addition pressure sensor 121 may sense intake manifold temperature); boost pressure from pressure sensor 122 exhaust gas oxygen concentration from oxygen sensor 126; an engine position sensor from an engine position sensor 118 sensing crankshaft 40 position; a measurement of air mass entering the engine from sensor 120 (e.g., a hot wire air flow meter); and a measurement of throttle position from sensor 60. Barometric pressure may also be sensed (sensor not shown) for processing by controller 12. In a preferred aspect of the present description, engine position sensor 118 produces a predetermined number of equally spaced pulses each revolution of the crankshaft from which engine speed (RPM) can be determined.

During operation, each cylinder within engine 10 typically undergoes a four-stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In some examples, fuel may be injected to a cylinder a plurality of times during a single cylinder cycle.

In a process hereinafter referred to as ignition, the injected fuel is ignited by compression ignition resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples. Further, in some examples a two-stroke cycle may be used rather than a four-stroke cycle.

Moving on to FIG. 2, a detailed schematic of a fuel system 200 is shown. Fuel system 200 includes fuel tank 26, low pressure fuel pump 206 (e.g., a first fuel pump that is electrically driven), high pressure fuel pump 21 (e.g., a second fuel pump that is driven via engine 10), fuel pump volume control valve 25, fuel pressure control valve 240, filter and water separator 210, fuel rail 205, fuel supply conduit 250, and fuel return conduit 252.

Operationally, controller 12 may command low pressure fuel pump 206 on or off according to vehicle operating conditions. When controller 12 activates low pressure fuel pump 206, fuel 232 is pressurized and supplied from fuel tank 26 to filter 210. Filtered fuel may move from filter to high pressure fuel pump 21 via fuel supply conduit 250. High pressure fuel pump 21 may be rotated via engine 10 and rotating high pressure fuel pump 21 may supply pressurized fuel to engine 10 via selectively opening fuel injectors 68. A temperature of high pressure fuel pump 21 may be estimated or sensed via temperature sensor 272. In one example, the temperature may be a temperature of fuel within high pressure fuel pump 21 at fuel pump outlet 270. In other examples, the temperature may be a temperature of a fuel pump component such as a housing, bearing, cam, plunger, cylinder wall, etc. High pressure fuel pump 21 may supply fuel that is at a higher pressure to engine 10 than fuel that is supplied to the high pressure fuel pump 21 via the low pressure fuel pump 206. Pressure control valve 240 may control pressure of fuel in fuel rail 205. Pressure control valve 240 may return excess fuel to fuel tank 26 via fuel return conduit 252. Controller 12 may adjust a position of volume control valve 25 to adjust the amount of fuel that may flow through high pressure fuel pump 21.

Thus, the system of FIGS. 1 and 2 provides for an engine system, comprising: a diesel engine; a first fuel pump; a second fuel pump including a volume control valve; and a controller including executable instructions stored in non-transitory memory that cause the controller to adjust an operating state of the first fuel pump in response to a temperature and a request to shutdown the diesel engine, where the temperature is a fuel temperature at the second fuel pump or a temperature of the second fuel pump. In a first example, the engine system includes where the fuel temperature at the second fuel pump is an outlet, inlet, or internal fuel temperature in the second fuel pump. In a second example that may include the first example, the engine system further comprises additional executable instructions to generate a fuel pump cooling request to cool the second fuel pump. In a third example that may include one or both of the first and second examples, the engine system includes where the cooling request is based on the temperature exceeding a threshold temperature. In a fourth example than may include one or more of the first through third examples, the engine system further comprises additional executable instructions to estimate deposit formation within the second fuel pump. In a fifth example than may include one or more of the first through fourth examples, the engine system further comprises additional instructions to generate a fuel pump flush request to reduce deposit formation within the second fuel pump. In a sixth example than may include one or more of the first through fifth examples, the engine method further comprises additional instructions to cycle the first fuel pump on and off a plurality of times in response to the fuel pump flush request being asserted.

Referring now to FIG. 3, an example prophetic engine operating sequence for the system of FIGS. 1 and 2 according to the method of FIGS. 4-6 is shown. The operating sequence of FIG. 3 may be produced via the system of FIGS. 1 and 2 executing instructions of the method described in FIGS. 4-6. The plots of FIG. 3 are aligned in time and occur at the same time. Vertical markers at t0-t5 indicate times of particular interest during the sequence. The SS marks along the horizontal axes of each plot represent breaks in time and the breaks may have a duration that is long or short.

The first plot from the top of FIG. 3 represents high pressure fuel pump temperature. The high pressure fuel pump temperature may be a temperature of a fuel pump component (e.g., housing, bearing, etc.) or a temperature of fuel within the fuel pump (e.g., fuel temperature at the high pressure fuel pump outlet or inlet). The fuel pump temperature may be measured or estimated. The vertical axis represents high pressure fuel pump temperature. The horizontal axis represents time and time increases from the left side to right side of the figure. Trace 302 represents high pressure fuel pump temperature and the high pressure fuel pump temperature increases in the direction of the vertical axis arrow. Horizontal line 350 represents a threshold temperature. When the temperature of the high pressure fuel pump is above the threshold temperature, operation of the low pressure fuel pump may be adjusted.

The second plot from the top of FIG. 3 represents a state of an engine shutdown request (e.g., a request to stop engine operation including stopping rotation of the engine) versus time. The vertical axis represents the state of the engine shutdown request and the engine shutdown request is asserted when trace 304 is at a higher level near the vertical axis arrow. The engine shutdown request is not asserted when trace 304 is at a lower level near the horizontal axis. The horizontal axis represents time and time increases from the left side to right side of the figure. Trace 304 represents the state of the engine shutdown request.

The third plot from the top of FIG. 3 represents a state of a high pressure fuel pump cooling request (e.g., a request to cool the high pressure fuel pump by flowing fuel through the high pressure fuel pump) versus time. The vertical axis represents the state of the high pressure fuel pump cooling request and the high pressure fuel pump cooling request is asserted when trace 306 is at a higher level near the vertical axis arrow. The high pressure fuel pump cooling request is not asserted when trace 306 is at a lower level near the horizontal axis. The horizontal axis represents time and time increases from the left side to right side of the figure. Trace 306 represents the state of the high pressure fuel pump cooling request.

The fourth plot from the top of FIG. 3 represents a state of a high pressure fuel pump flushing request (e.g., a request to flush fuel deposit forming fuel from the high pressure fuel pump) versus time. The vertical axis represents the state of the high pressure fuel pump flushing request and the high pressure fuel pump flushing request is asserted when trace 308 is at a higher level near the vertical axis arrow. The high pressure fuel pump flushing request is not asserted when trace 308 is at a lower level near the horizontal axis. The horizontal axis represents time and time increases from the left side to right side of the figure. Trace 308 represents the state of the high pressure fuel pump flushing request.

The fifth plot from the top of FIG. 3 represents an operating state (e.g., on or off) of a low pressure fuel pump versus time. The vertical axis represents the state of the low pressure fuel pump and the low pressure fuel pump is on when trace 310 is at a higher level near the vertical axis arrow. The low pressure fuel pump is off when trace 310 is at a lower level near the horizontal axis. The horizontal axis represents time and time increases from the left side to right side of the figure. Trace 310 represents the state of the low pressure fuel pump.

At time t0, the engine is running (e.g., rotating and combusting fuel) and the high pressure fuel pump temperature is less than threshold 350. The engine shutdown request is not asserted and the high pressure fuel pump cooling request is not asserted. The high pressure fuel pump flush request is not asserted and the low pressure fuel pump is activated.

At the time t1, the engine shutdown request is asserted and the low pressure fuel pump is deactivated in response to the high pressure fuel pump cooling request and the high pressure fuel pump flushing request not being asserted. The high pressure fuel pump cooling request and the high pressure fuel pump flush request are not asserted because the high pressure fuel pump temperature is less than threshold 350. The first portion of the engine operating sequence ends at time t2.

Thus, if an engine shutdown is requested when the high pressure fuel pump temperature is less than a threshold, the low pressure fuel pump may be deactivated to conserve power. However, if the high pressure fuel pump temperature is above threshold 350 while the engine shutdown request is asserted, the low pressure fuel pump may remain activated as shown in the remaining portions of the present operating sequence.

Between time t2 and time t3, the engine is restarted and running. The high pressure fuel pump temperature is greater than threshold 350. The engine shutdown request is not asserted and the high pressure fuel pump cooling request is not asserted. The high pressure fuel pump flush request is not asserted and the low pressure fuel pump is activated.

At the time t3, the engine shutdown request is asserted and the low pressure fuel pump remains activated in response to the high pressure fuel pump cooling request being asserted. The high pressure fuel pump flushing request is not asserted. The high pressure fuel pump cooling request is asserted because the high pressure fuel pump temperature is greater than threshold 350. The high pressure fuel pump flushing request is not asserted since the fuel deposit model (not shown) is not predicting greater than a threshold amount of fuel deposit formation within the high pressure fuel pump. This second portion of the engine operating sequence ends at time t4.

Thus, if an engine shutdown is requested when the high pressure fuel pump temperature is greater than a threshold, the low pressure fuel pump may be activated to cool the high pressure fuel pump. Fuel may flow through the high pressure fuel pump, thereby cooling the high pressure fuel pump, when the low pressure fuel pump is activated.

Between time t4 and time t5, the engine is restarted and running. The high pressure fuel pump temperature is less than threshold 350. The engine shutdown request is not asserted and the high pressure fuel pump cooling request is not asserted. The high pressure fuel pump flush request is not asserted and the low pressure fuel pump is activated.

At the time t5, the engine shutdown request is asserted and the low pressure fuel pump remains activated in response to the high pressure fuel pump flushing request being asserted. The high pressure fuel pump cooling request is not asserted. The high pressure fuel pump flushing request is asserted because the fuel deposit model (not shown) output is greater than a predetermined threshold (not shown). The high pressure fuel pump cooling request is not asserted since the high pressure fuel pump temperature is not greater than threshold 350. The low pressure fuel pump is cycled between an off state and an on state so as to flush fuel that may be transformed into fuel deposits in the high pressure fuel pump. The low pressure fuel pump may be cycled between off and on states a plurality of times as shown.

Thus, if an engine shutdown is requested when greater than a threshold amount of fuel deposits may be expected to form in the high pressure fuel pump, the low pressure fuel pump may be activated to flush the high pressure fuel pump. The pulsed fuel flow through the high pressure fuel pump may tend to increase flushing of fuel and deposits from the high pressure fuel pump.

Referring now to FIG. 4, a block diagram of a portion of a method for operating an internal combustion engine of a vehicle is shown. FIGS. 5 and 6 describe the remainder of the method for operating the engine. The method of FIGS. 4-6 may be at least partially implemented as executable instructions stored in memory of one or more controllers in the system of FIGS. 1 and 2. Further, the method of FIGS. 4-6 may include actions taken in the physical world by a controller to transform an operating state of the system of FIGS. 1 and 2. Additionally, the method of FIGS. 4-6 may provide at least portions of the operating sequence shown in FIG. 3. FIG. 4 is a high level block diagram that includes blocks that represent control routines (e.g., executable instructions stored in non-transitory memory) that are shown in greater detail in FIGS. 5 and 6. The blocks (e.g., 404, 406, 504-524, and 602-652) represent software instructions within controller 12.

Controller 12 includes control routines 404 and 406 for shutting down a fuel system that includes a high pressure fuel pump and a low pressure fuel pump. Controller 12 may selectively activate and deactivate low pressure fuel pump 206. Additionally, in some examples, controller 12 may adjust a position of volume control valve 25 and pressure control valve 240. Controller 12 may receive a request to shut down the vehicle's engine and fuel system including high pressure fuel pump 21 by operator 450 via human/machine interface 69. A fuel cooling and fuel flushing shutdown request module 404 may receive the engine shutdown request and additional inputs 410 that are indicative of vehicle operating conditions. A fuel cooling control module 406 may also receive the engine shutdown request and additional inputs 412 that are indicative of vehicle operating conditions. The fuel cooling control module 406 may control operation of the low pressure fuel pump 206, and optionally, volume control valve 25. The engine shutdown request may be a logical true or one when an engine shutdown is requested and the engine shutdown request may be a logical false or zero when an engine shutdown is not requested.

Turning now to FIG. 5, a block diagram of a fuel cooling and fuel flushing shutdown request module 404 is shown. Fuel cooling and fuel flushing shutdown request module 404 may generate a cooling request for the high pressure fuel pump cooling and/or a flushing request for the high pressure fuel pump.

Low pressure fuel pump flow (e.g., the flow rate of fuel through the low pressure fuel pump) and low pressure fuel pump inlet fuel temperature are input to fuel cooling estimation block 504. In one example, block 504 references a table or function of empirically determined fuel cooling values according to the low pressure fuel pump fuel flow and the low pressure fuel pump inlet temperature. Block 504 outputs an amount of heat that may be output or absorbed by the high pressure fuel pump and that is based on fuel cooling to Cam-roller tappet interface temperature model 510 (e.g., a model that outputs a temperature of the higher pressure pump at the cam and roller tappet interface).

Engine speed and fuel rail pressure are input to mechanical heating estimation block 506. In one example, block 506 references a table or function of empirically determined mechanical heating values for the high pressure fuel pump according to the engine speed and the fuel rail pressure. Block 506 outputs an amount of heat that may be output or absorbed by the high pressure fuel pump and that is based on engine speed and fuel rail pressure to Cam-roller tappet interface temperature model 510.

Ambient air temperature and exhaust temperature are input to ambient heating estimation block 508. In one example, block 508 references a table or function of empirically determined ambient heating values for the high pressure fuel pump according to the ambient air temperature and the exhaust temperature. Block 508 outputs an amount of heat output or absorbed by the high pressure fuel pump that is based on ambient temperature and exhaust temperature to Cam-roller tappet interface temperature model 510.

At block 510, the Cam-roller tappet interface temperature model outputs a temperature estimate of the higher pressure fuel pump to blocks 514, 515, 650, and 652 and indicated by the arrows exiting block 510. Block 514 uses the higher pressure fuel pump temperature estimate to estimate a temperature of fuel in the higher pressure fuel pump. Block 514 outputs the temperature of fuel in the higher pressure fuel pump to the fuel deposit model at block 520.

At block 515, output of block 510 (e.g., roller tappet temperature) is compared to a high pressure fuel pump cooling threshold temperature. If the output of block 510 is greater than the high pressure fuel pump cooling threshold temperature, block 515 outputs a logical true or 1 to switch block 516. Block 516 has data inputs zero and one as well as a control input. A logical zero is input to the data input labeled one and the output of block 510 is input to the data input labeled zero of block 516. The engine shutdown request is input to the control input of block 516 and block 516 outputs the output of block 515 or zero according to the engine shutdown request state. The engine shutdown request is one when the engine is running and zero when the engine is stopped or requested to stop. If the engine shutdown request is present at switching block 516 and the roller tappet temperature is greater than the high pressure fuel pump cooling threshold temperature, block 516 outputs a logical true or one to generate a high pressure fuel pump cooling request.

The fuel temperature in the higher pressure fuel pump from block 514 is input to the high pressure fuel pump fuel deposit model block 520. The high pressure fuel pump deposit model block 520 also receives input of fuel type (e.g., biodiesel, diesel, etc.) and fuel age. The fuel age may be determined by accumulating an amount of time between fuel tank refills and the fuel type may be estimated based on combustion properties of fuel as estimated from torque the engine produces and oxygen sensor output. The fuel type, fuel age, and roller tappet temperature may be applied to reference a look-up table or function that includes empirically determined high pressure fuel pump deposit estimates. The function or table outputs a high pressure fuel pump fuel deposit amount estimate from block 520 to block 522.

At block 522, output of block 520 (high pressure fuel pump fuel deposit amount) is compared to a high pressure fuel pump fuel deposit amount threshold. If the output of block 520 is greater than the high pressure fuel pump deposit amount threshold, block 522 outputs a logical true or 1 to switch block 524. If the engine shutdown request is present switching block 524 and the high pressure fuel pump fuel deposit amount is greater than the higher pressure fuel pump fuel deposit amount threshold, block 524 outputs a logical true or one to generate a higher pressure fuel pump flush request. The higher pressure fuel pump flush request is input to blocks 608, 610, and 614.

In this way, fuel cooling and fuel flushing shutdown request module 404 may selectively generate high pressure fuel pump cooling and flushing requests. The high pressure fuel pump cooling and flushing requests may be provided to the fuel cooling control module 406.

Referring now to FIG. 6, a block diagram of a fuel cooling control module 406 is shown. Fuel cooling and fuel flushing shutdown request module 404 may generate a low pressure fuel pump on/off request for cooling the high pressure fuel pump.

Ambient air temperature and the fuel temperature in the higher pressure fuel pump are input to the high pressure fuel pump cooling time on estimation block 602. In one example, block 602 references a table or function of empirically determined amounts of time to cool the high pressure fuel pump (cool time on) according to the ambient air temperature and the fuel temperature in the higher pressure fuel pump. Block 602 outputs an amount of time that the high pressure fuel pump is to be cooled via supplying fuel to the high pressure fuel pump via the low pressure fuel pump while the engine is not rotating. The amount of time that the high pressure fuel pump is to be cooled via supplying fuel to the high pressure fuel pump via the low pressure fuel pump is input to dividing block 604 and minimizing block 606.

The high pressure fuel pump roller tappet temperature output from block 510 of FIG. 5 is input to blocks 650 and 652. In one example, block 650 references a table or function of empirically determined amounts of time to flush the high pressure fuel pump according to the high pressure fuel pump roller tappet temperature estimate. Block 650 outputs an amount of time that the high pressure fuel pump is to be flushed (flush cycle time) via pulsing fuel that is supplied to the high pressure fuel pump via the low pressure fuel pump as shown in FIG. 3. The amount of time that the high pressure fuel pump is to be flushed via supplying fuel to the high pressure fuel pump via the low pressure fuel pump is input to switch block 608. Similarly, block 652 references a table or function of empirically determined flushing cycles (e.g. the actual total number of times that the low pressure fuel pump is to be cycled off and on after an engine stop request) according to the high pressure fuel pump roller tappet temperature estimate. Block 652 outputs an actual total number of flushing cycles that the high pressure fuel pump is to be flushed via pulsing fuel that is supplied to the high pressure fuel pump via the low pressure fuel pump as shown in FIG. 3. The actual total number of times that the high pressure fuel pump is to be cycled during flushing is input to switch block 610.

Switching block 608 has data inputs zero and one as well as a control input. The higher fuel pump flush cycle time is input to the data input labeled one and a low pressure (LP) fuel pump maximum on time (e.g., a maximum amount of time that the low pressure pump may be operated) is input to the data input labeled zero of switching block 608. The higher pressure pump flush request is input to the control input of block 608 and block 608 outputs the flush cycle time or the low pressure pump maximum on time according to the higher pressure fuel pump flush request state. The higher fuel pump flush request value is true or one when the flushing of the higher pressure fuel pump is requested while the engine is not rotating. If the higher pressure fuel pump request is present at switching block 608, switching block 608 outputs the higher pressure fuel pump flush cycle time. Otherwise, switching block 608 outputs the low pressure fuel pump maximum on time.

Minimization block 606 outputs a lower value of the output of block 602 (cooling on time) or the output of block 608 (low pressure pump maximum on time or higher pressure fuel pump flush cycle time). The output of minimization block 606 is input to block 604 and block 602.

At dividing block 604, the high pressure fuel pump cooling time on that is output from block 602 is divided by a maximum amount of time that the low pressure fuel pump may be activated after the engine shutdown request is asserted. Dividing block 604 outputs an actual total number of high pressure fuel pump cooling cycles to maximizing block 612. Maximizing block 612 selects and outputs the maximum value from the value that is output from block 610 and the value that is output from block 604. The output of maximizing block 612 is input to less than block 618. Thus, if block 610 outputs 10 higher pressure pump flush cycles and block 604 outputs 20 higher pressure pump cooling cycles, block 612 outputs 20 higher pressure pump cooling cycles.

Switching block 610 has data inputs zero and one as well as a control input. A logical false or zero input to the data input labeled zero and the actual total number of higher pressure fuel pump flush cycles is input to the data input labeled one of switching block 610. The higher pressure pump flush request is input to the control input of block 610. Block 610 outputs the zero or the actual total number of higher pressure pump cycles according to the higher pressure fuel pump flush request state. The higher fuel pump flush request value is true or one when the flushing of the higher pressure fuel pump is requested while the engine is not rotating. If the higher pressure fuel pump request is present at switching block 610, switching block 610 outputs the actual total number of higher pressure fuel pump flush cycles. Otherwise, switching block 610 outputs zero. The output of block 610 is input to maximizing block 612.

Logical OR block 614 performs a logical OR operation on the higher pressure fuel pump flush request and the higher pressure fuel pump cooling request. If either of the higher pressure fuel pump flush request or the higher pressure fuel pump cooling request is true, then block 614 outputs a value of one or true to switching block 626. If neither of the higher pressure fuel pump flush request and the higher pressure fuel pump cooling request is true, then block 614 outputs a value of zero or false to switching block 626.

Switching block 626 has data inputs zero and one as well as a control input. A logical false or zero input to the data input labeled zero and the output of block 629 is input to the data input labeled one of switching block 626. The output of block 614 is input to the control input of block 626. Block 626 outputs the zero or the output of block 629 according to the output of block 614. If the output of block 614 is one or true at switching block 626, switching block 626 outputs the output of block 629. Otherwise, switching block 626 outputs zero. The output of block 626 is input to counter 616, AND block 622, and reset timer 628.

Counter block 616 increments an internal count value by a value of one for every time a low state (zero/false) to high state (one/true) is observed at input In. Counter 616 outputs a present count value at output Count. Counter 616 sets the internal count value and the Count output to zero when a one/true is observed at the Reset input. Counter block 616 outputs a count value to less than block 618. Less than block 618 judges if the output of maximizing block 612 is less than the output of counter block 616. If so, less than block 618 outputs a value of one or true. If not, less than block 618 outputs a value of zero or false to AND block 622. A logical NOT operation is performed on the output of less than block 618 by NOT block 620 and NOT block 620 outputs the logical NOT output of less than block 618 to Reset input of counter block 616. Logical AND block 622 performs a logical AND on the output of less than block 618 and the output of switch block 626. If the output of less than block 618 is one/true and the output of switching block 626 is one/true, then the output of AND block 622 is one/true and the low pressure fuel pump is activated. Otherwise, the output of AND block 622 is zero/false and the low pressure pump is deactivated.

Reset timer block 628 outputs an accumulated amount of time since a value of true or one was input to the Reset input of the reset timer block 628 and reset timer block 628 was enabled. The reset timer block 628 increases an accumulated amount of time in increments of a change in time or A time that is input to the A Time input of the reset timer block 628. The reset timer is enabled (allows incrementing of the accumulated amount of time) when a value true/one is input to the Enable input of the reset timer block 628. The output of switching block 626 is input to the Enable input of reset timer 628 and into the input of NOT block 630. NOT block 630 outputs the logical NOT of the output of switching block 626. The accumulated time in reset timer block 628 is output from output Time out to less than block 629. Less than block 629 judges if the output of minimizing block 606 is less than the output of reset timer block 628. If so, less than block 628 outputs a value of one or true to the one input of switching block 626. If not, less than block 628 outputs a value of zero or false to the one input of switching block 626.

In this way, the method of FIGS. 4-6 may selectively activate and deactivate a low pressure fuel pump to cool or flush a high pressure fuel pump. The cooling and purging may operate to reduce high pressure fuel pump degradation.

Thus, the method of FIGS. 4-6 provides for an engine operating method, comprising: via a controller, adjusting an operating state of a first fuel pump in response to an engine shutdown request and a temperature, the first fuel pump arranged serially with a second fuel pump. The engine operating method includes where the first fuel pump is electrically driven and where the second fuel pump is driven via an engine. In a second example that may include the first example, the engine operating method includes where adjusting the operating state of the first fuel pump includes turning off the first fuel pump in response to the temperature being less than a threshold temperature and the engine shutdown request being asserted. In a third example that may include one or both of the first and second examples, the engine operating method includes where adjusting the operating state of the first fuel pump includes turning on the first fuel pump in response to the temperature being greater than a threshold temperature and the engine shutdown request being asserted. In a fourth example that may include one or more of the first through third examples, the engine operating includes where the temperature is an outlet fuel temperature at the first fuel pump. In a fifth example that may include one or more of the first through fourth examples, the engine operating method includes where adjusting the operating state of the first fuel pump includes leaving on the first fuel pump in response to the temperature being greater than a threshold temperature and the engine shutdown request being asserted. In a sixth example that may include one or more of the first through fifth examples, the engine operating method includes where adjusting the operating state of the first fuel pump includes cycling the first fuel pump on and off a plurality of times in response to the temperature being greater than a threshold temperature and the engine shutdown request being asserted. In a seventh example that may include one or more of the first through sixth examples, the engine method further comprises adjusting an operating state of a volume control valve that controls flow of a fluid through the second fuel pump and a pressure control valve in the fuel rail in response to the engine shutdown request and the temperature via the controller.

Additionally, the methods of FIGS. 4-6 provides for an engine operating method, comprising: via a controller, cycling a first fuel pump on and off a plurality of times in response to an engine shutdown request and an output of a fuel deposit model, the first fuel pump arranged serially with a second fuel pump. In a first example, the engine method includes where the output of the fuel deposit model is based on a type of fuel in the second fuel pump. In a second example that may include the first example, the engine method includes where the output of the fuel deposit model is based on an estimate of an amount of time a fuel has been onboard a vehicle. In a third example that may include one or both of the first and second examples, the engine method includes where the output of the fuel deposit model is based on a temperature at the second fuel pump. In a fourth example that may include one or more of the first through third examples, the engine method includes where the temperature at the second fuel pump is a fuel temperature.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. Further, portions of the methods may be physical actions taken in the real world to change a state of a device. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example examples described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller. One or more of the method steps described herein may be omitted if desired.

It will be appreciated that the configurations and routines disclosed herein are exemplary in nature, and that these specific examples are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims may be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine operating method, comprising:

via a controller, adjusting an operating state of a first fuel pump in response to an engine shutdown request and a temperature, the first fuel pump arranged serially with a second fuel pump.

2. The engine operating method of claim 1, where the first fuel pump is electrically driven and where the second fuel pump is driven via an engine.

3. The engine operating method of claim 1, where adjusting the operating state of the first fuel pump includes turning off the first fuel pump in response to the temperature being less than a threshold temperature and the engine shutdown request being asserted.

4. The engine operating method of claim 1, where adjusting the operating state of the first fuel pump includes turning on the first fuel pump in response to the temperature being greater than a threshold temperature and the engine shutdown request being asserted.

5. The engine operating method of claim 1, where the temperature is an outlet fuel temperature at the first fuel pump.

6. The engine operating method of claim 1, where adjusting the operating state of the first fuel pump includes leaving on the first fuel pump in response to the temperature being greater than a threshold temperature and the engine shutdown request being asserted.

7. The engine operating method of claim 1, where adjusting the operating state of the first fuel pump includes cycling the first fuel pump on and off a plurality of times in response to the temperature being greater than a threshold temperature and the engine shutdown request being asserted.

8. The engine operating method of claim 1, further comprising adjusting an operating state of a volume control valve that controls flow of a fluid through the second fuel pump and a pressure control valve in the fuel rail in response to the engine shutdown request and the temperature via the controller.

9. An engine system, comprising:

a diesel engine;

a first fuel pump;

a second fuel pump including a volume control valve; and a controller including executable instructions stored in non-transitory memory that cause the controller to adjust an operating state of the first fuel pump in response to a temperature and a request to shutdown the diesel engine, where the temperature is a fuel temperature at the second fuel pump or a temperature of the second fuel pump.

10. The engine system of claim 9, where the fuel temperature at the second fuel pump is an outlet, inlet, or internal fuel temperature in the second fuel pump.

11. The engine system of claim 9, further comprising additional executable instructions to generate a fuel pump cooling request to cool the second fuel pump.

12. The engine system of claim 11, where the fuel pump cooling request is based on the temperature exceeding a threshold temperature.

13. The engine system of claim 9, further comprising additional executable instructions to estimate deposit formation within the second fuel pump.

14. The engine system of claim 13, further comprising additional instructions to generate a fuel pump flush request to reduce deposit formation within the second fuel pump.

15. The engine system of claim 14, further comprising additional instructions to cycle the first fuel pump on and off a plurality of times in response to the fuel pump flush request being asserted.

16. An engine operating method, comprising:

via a controller, cycling a first fuel pump on and off a plurality of times in response to an engine shutdown request and an output of a fuel deposit model, the first fuel pump arranged serially with a second fuel pump.

17. The engine operating method of claim 16, where the output of the fuel deposit model is based on a type of a fuel in the second fuel pump.

18. The engine operating method of claim 17, where the output of the fuel deposit model is based on an estimate of an amount of time the fuel has been onboard a vehicle.

19. The engine operating method of claim 16, where the output of the fuel deposit model is based on a temperature at the second fuel pump.

20. The engine operating method of claim 19, where the temperature at the second fuel pump is a fuel temperature.

* * * * *